US006221570B1

(12) United States Patent
Papai

(10) Patent No.: US 6,221,570 B1
(45) Date of Patent: Apr. 24, 2001

(54) ONE-PART BLEACH-FIX LIQUID CONCENTRATES

(75) Inventor: Laszlo Papai, Ballwin, MO (US)

(73) Assignee: Trebla Chemical Company, St Louis, MO (US)

( * ) Notice: Subject to any disclaimer, the term of this patent is extended or adjusted under 35 U.S.C. 154(b) by 0 days.

(21) Appl. No.: 09/477,565

(22) Filed: Jan. 6, 2000

(51) Int. Cl.[7] ..... G03C 7/42
(52) U.S. Cl. ..... 430/459; 430/460
(58) Field of Search ..... 430/459, 460

(56) References Cited

U.S. PATENT DOCUMENTS

| | | | | |
|---|---|---|---|---|
| 3,751,251 | | 8/1973 | Surash | 430/400 |
| 4,956,268 | | 9/1990 | Nakazyo | 430/393 |
| 5,055,382 | | 10/1991 | Long et al. | 430/400 |
| 5,070,004 | | 12/1991 | Fujita et al. | 430/393 |
| 5,110,716 | * | 5/1992 | Kuse et al. | 430/429 |
| 5,310,633 | | 5/1994 | Yoshida et al. | 430/458 |
| 5,314,791 | | 5/1994 | Ishikawa et al. | 430/393 |
| 5,354,647 | | 10/1994 | Fryson | 430/393 |
| 5,441,852 | * | 8/1995 | Hagiwara et al. | 430/372 |

* cited by examiner

*Primary Examiner*—Hoa Van Le
(74) *Attorney, Agent, or Firm*—Howard M. Ellis; Marianne Fuierer

(57) ABSTRACT

The present invention provides compositions and methods of making one-part bleach-fix liquid concentrates, packaged in a single unit, wherein the bleaching agent is a polyvalent metal oxidizing agent that is protected from reduction for an extended period of time by incorporating a thiocyanate salt as at least one fixing agent. The thiocyanate salt in added in an amount sufficient to provide one-part bleach-fix liquid concentrates that are homogeneous, essentially free of crystallized components and which retain effective oxidizing potential during extended storage.

39 Claims, No Drawings

ONE-PART BLEACH-FIX LIQUID CONCENTRATES

This invention relates in general to photographic processing and in particular to compositions and methods of making bleach-fix concentrates. More specifically, this invention describes one-part bleach-fix liquid concentrates that remain free of crystallized precipitates and retain optimal oxidizing capability during extended storage.

BACKGROUND OF THE INVENTION

Color developers produce a combined silver and dye image, and if clear colors are to be obtained the silver image must be removed. This can be accomplished by oxidizing the metallic silver with a suitable oxidizing agent, commonly referred to as a bleaching agent. This is followed by dissolving any remaining light-sensitive silver halide in a silver halide solvent, commonly referred to as a fixing agent. These bleaching and fixing processes may be performed sequentially in two separate solutions or in the alternative, the bleaching agent and fixing agents can be combined into a single bleaching-fixing solution.

The form in which the bleaching and fixing agents are typically employed is a dilute aqueous solution and thus it is not generally feasible, from an economic standpoint, to package, transport, and store solutions of working strength, since this would involve the packaging, transport and storage of large amounts of water. As such, the bleaching and fixing solutions are prepared immediately before use by dissolving the necessary ingredients in water. In the alternative a bleach/fix solution may be prepared by mixing bleaching and fixing solutions together that have been prepared separately such as disclosed in U.S. Pat. No. 5,070,004 issued to Yoshihiro Fujita et al. Preparation immediately before use is necessitated by the fact that individual components of the separate solutions can chemically react and quickly decompose and/or oxidize reactive components thereby diminishing the useful life of the working solution.

The prevalence of automatic processing systems used in small photographic service laboratories called "mini labs", that are supervised by technicians with limited technical background, necessitates the need for providing almost foolproof premixed solutions. However, as stated above, full working solutions that are ready-to-use make shipping more expensive, and further, the containers take up valuable storage space. To overcome these disadvantages, there has been a trend to reduce the size of packaging, and thus, provide a savings in shipping costs. One way to achieve this goal is to make either all-powder or liquid bleaching, fixing, and/or bleach-fixing concentrates. These concentrates merely have to be dissolved in or diluted with water to form a working solution.

However, because of the serious problem of unwanted chemical reactions that occur between the components, the bleaching and fixing concentrates are usually separated into two or more parts which are subsequently combined to form a working solution. For instance, a two-part bleach-fixing liquid concentrate is disclosed in U.S. Pat. No. 4,956,268 issued to Kiyoshi Nakazyo et al, wherein a first concentrate comprises a silver halide solvent and the second concentrate contains an oxidizing agent. The components are packaged separately from each other to prevent chemical reactions that form undesirable reaction products, such as crystallized precipitates. For instance, when a bleaching concentrate containing a ferric ion solution is put together with a fixing concentrate containing a thiosulfate solution the concentrate will have a very short shelf life because the ferric ion can be reduced to a ferrous ion and the thiosulfate can sulphurize thereby rendering the combined concentrate inactive.

While the higher degree of concentration will reduce some of the volume of water the two separate concentrates are still not sufficiently compact to substantially reduce the cost of shipping and/or the necessary storage space.

In an attempt to provide a one-part concentrate, U.S. Pat. No. 5,310,633 issued to Yoshida et al discloses a one-part powdery bleach-fixing composition. Powdered components tend to solve the disadvantages of shipping and storing separate liquid concentrates but lumping or caking of the dry components, especially the thiosulfate, can occur during shipping and/or storage thereby making it difficult to provide a homogenous solution upon dilution.

U.S. Pat. No. 3,751,251 provides for a one-part liquid bleach-fix concentrated regenerator. As described in this reference an aqueous solution of an aminopolycarboxylic acid and a thiosulfate ion are mixed along with a sufficient amount of a sulfite ion, in the form of gaseous sulfur dioxide, to adjust the pH of the solution to between 5.4 and 6.0. However, this product still has a limited shelf life due to undesirable crystal formation in the concentrate.

Accordingly, there is a need for improved one-part bleach-fix liquid concentrates which can be shipped economically, require minimal storage space, eliminate the need for mixing several different components, retain oxidizing ability and prevent crystals from forming in the concentrate.

SUMMARY OF INVENTION

Accordingly, it is a primary object of the present invention to provide one-part bleach-fix liquid concentrates having extended storability while maintaining stability.

It is another object to provide one-part bleach-fix liquid concentrates wherein crystallized precipitates are essentially non-existent after a year of storage.

Yet another object of the present invention is to provide one-part bleach-fix liquid concentrates wherein the polyvalent metal complexed oxidizing agent maintains its oxidizing ability for an extended time.

A further object of the present invention is to provide one-part bleach-fix liquid concentrates that upon dilution will provide working solutions wherefrom silver recovery can be performed electrolytically while reducing the risk of forming toxic hydrogen cyanide gas.

A still further object of the present invention is to provide one-part liquid beach-fix concentrates that reduce transportation and packaging costs.

These and other objects of the present invention will be clear from the following description.

The inventor of the present invention found that one-part bleach-fix liquid concentrates can be prepared that have an extended shelf life without forming crystallized precipitates therein by combining a bleaching agent with at least a thiocyanate salt used as a fixing agent. Further, after intensive investigations, it has been found that when a thiocyanate salt is used and/or combined in a specific ratio with another fixing agent, the one-part liquid bleach-fix concentrate has increased stability and crystal formation is essentially eliminated. Still further, it is surprising that when the amount by weight of the thiocyanate salt is less than the amount by weight of the other fixing agent the oxidizing ability of the diluted working solution made from the present concentrates is not decreased even after many months of storage.

In accordance with the present invention there is provided a one-part bleach-fix liquid concentrate which comprises:

a) a bleaching agent that oxidizes metallic silver; and b) a fixing mixture comprising at least a thiocyanate salt, the thiocyanate salt in an effective amount to substantially retard crystal formation in the one-part bleach-fix liquid concentrate thereby extending the shelf-life of the one-part bleach-fix liquid concentrate. The concentrate remains essentially free of crystallized precipitates during the extended shelf-life.

More preferably, there is provided a first and second fixing agent wherein the first fixing agent is a thiocyanate salt and the second fixing agent is selected from the group which includes thiosulfate salts, thioethers compounds, thioureas, thioglycolic acid and the like.

The bleaching agent may be selected from the group consisting of compounds of polyvalent metals such as iron, (III), cobalt (III), chromium(VI), and copper (II); peracids; quinones; nitro compounds and mixtures thereof. The compounds of the polyvalent metals may include iron (III) compounds such as ferric chloride; ferricyanide; bichromates; and organic complexes with aminopolycarboxylic acids, aminopolyphosphonic acids and organic phosphonic acids.

It has been found that the polyvalent metal oxidizing agent does not precipitate out of the concentrate when a thiocyanate fixing agent is used and/or combined with a second fixing agent. The shelf-life of the concentrate increases as the amount of thiocyanate salt increases in the one-part bleach-fix liquid concentrate. The thiocyanate salt in the one-part bleach-fix liquid concentrate is generally used in an amount greater than 0.1 mole/liter to less than 1 mole/liter of concentrate.

The present invention can include additional photographic processing agents; such as preservatives, alkaline agents, buffering agents, bleaching accelerators, brightening agents, anti-staining agents, defoaming agents, surfactants, fungicides, anticorrosion agents and organic solvents.

The present invention also provides a method for processing a color photographic silver halide photosensitive material after imagewise exposure using a one-part bleach-fix liquid concentrate, comprising the steps of color developing and processing with a bleach-fix solution wherein the bleach-fix solution is a one-part bleach-fix liquid concentrate diluted with a sufficient amount of water to prepare a working strength solution, the one-part bleach-fix liquid concentrate is an aqueous solution comprising:

a) a bleaching agent which is a polyvalent metal oxidizing agent; and b) a mixture of at least a first and second fixing agent, the first fixing agent is a thiocyanate salt, the thiocyanate salt in a sufficient amount to substantially retard crystal formation in the one-part bleach-fix liquid concentrate thereby extending the shelf-life of the concentrate.

The present invention further provides a method of increasing the resistance to the formation of crystallized precipitates in a one-part bleach-fix liquid concentrate comprising:

a) providing a bleaching agent which is a polyvalent metal complexed oxidizing agent; and b) combining with the bleaching agent a mixture of at least a first and second fixing agent, the first fixing agent which is a thiocyanate salt which is in a sufficient amount to substantially retard crystal formation in the one-part bleach-fix liquid concentrate.

Still further, the present invention provides for a method of making a one-part bleach-fix liquid concentrate comprising the step of combining a bleaching agent which is a metal complexed oxidizing agent and at least a first and second fixing agent, at least the first fixing agent is a thiocyanate salt and in a sufficient amount to substantially retard crystal formation in the one-part bleach-fix liquid concentrate. The metal complexed oxidizing agent is preferably a polyvalent metal complexed oxidizing agent, and more preferably, a polyvalent metal selected from the group of iron, copper, cobalt and chromium. When using at least two different fixing agents, the thiocyanate salt is preferably in an amount by weight less than the amount by weight of the second fixing agent. More preferably, the thiocyanate salt is in a sufficient amount to substantially retard crystal formation in the one-part bleach-fix liquid concentrate but not exceeding an amount that will produce toxic hydrogen cyanide gas during silver recovery using electrolytic systems. The second fixing agent may be a thiosulfate salt.

Yet another embodiment of the present invention provides for a photographic bleach-fix kit comprising a one-part bleach-fix liquid concentrate which upon dilution with a sufficient amount of water provides a working strength bleach-fix solution, the kit comprising a single package containing a concentrated aqueous solution comprising a bleaching agent that oxidizes metallic silver and at least a thiocyanate salt in a sufficient amount to substantially retard crystal formation in the one-part bleach-fix liquid concentrate.

Another embodiment of the one-part bleach-fix liquid concentrate kit may comprise:

a concentrated aqueous solution comprising:

i) a bleaching agent that oxidizes metallic silver; and ii) a mixture of at least a first and second fixing agent, the first fixing agent is a thiocyanate salt, the thiocyanate salt in a sufficient amount to substantially retard crystal formation in the one-part bleach-fix liquid concentrate.

The bleach-fix components in the single packaging kit have excellent shelf life characteristics because any adverse interactions between the components are effectively avoided by the optimal quantitative ratio of the fixing agents with one of the fixing agents being a thiocyanate salt.

Whereas, the one-part bleach-fix liquid concentrates of the present invention can be diluted into working solutions that have excellent bleach-fixing power, it is effectively applicable to the processing of not only low speed but also high speed light-sensitive silver halide color photographic materials. Further, it can be applied in common to the processing of every type of light-sensitive silver halide color photographic materials which are required to be bleached and fixed, for example, color printing light-sensitive materials such as photographic printing papers and photographing light-sensitive materials including negative color films, reversal color films, etc.

The one-part bleach-fix liquid concentrates of the present invention have a pH from about 5.6 to about 5.9 which upon dilution with water yield working strength solutions having a pH from about 5.5 to about 6.0 for bleaching and fixing photographic materials. The dilution factor ranges from about one part concentrate to two parts of water (1:2) by volume to about 1:6, and more preferably from about 1:2 to 1:4 by volume.

DETAILED DESCRIPTION OF THE INVENTION

The present invention provides compositions and methods of making one-part bleach-fix liquid concentrates, packaged in a single unit, wherein the bleaching agent is a polyvalent metal oxidizing agent which is protected from reduction for an extended period of time by incorporating a thiocyanate fixing agent. More preferably, a quantitative ratio of at least two fixing agents are combined wherein one of the fixing agents is a thiocyanate salt in a sufficient amount to provide a one-part liquid concentrate that is homogeneous, essentially free of crystallized components and which retains effective oxidizing potential during extended storage.

As stated above, if clear colors are to be obtained the silver image must be removed leaving only the dye image. This can be accomplished by oxidizing the metallic silver with a suitable oxidizing agent, commonly referred to as a bleaching agent. As such, preparation of the one-part bleach-fix liquid concentrates of the types described above comprise a bleaching agent. Generally any bleaching agent that oxidizes metallic silver may be used in the present invention. Preferably, the bleaching agents used herein include compounds of polyvalent metals such as iron, (III), cobalt (III), chromium(VI), and copper (II); peracids; quinones; and nitro compounds. Typical bleaching agents used herein are iron salts, such as ferric chloride; ferricyanides; bichromates; and organic complexes with aminopolycarboxylic acids, aminopolyphosphonic acids and organic phosphonic acids for forming the organic complex salts of iron (III) include:

nitrilotriacetic acid,
nitrilotripropionic acid,
1,2-Diaminopropanetetraacetic acid,
cyclohexanediaminetetraacetic acid,
ethylenediaminetetraacetic acid,
propylenediaminetetraacetic acid,
diethylenetriaminepentaacetic acid,
ortho-diaminecyclohexanetetraacetic acid,
ethylene glycol bis(aminoethyl ether) tetraacetic acid,
diaminopropanol tetraacetic acid,
N-(-2-hydroxyethyl)ethylenediaminetriacetic acid,
ethyliminodipropionic acid,
iminodiacetic acid,
methyliminodiacetic acid,
ethyliminodiacetic acid,
phenylenediaminetetraacetic acid,
2-Phosphonobutane-1,2,4-triacetic acid,
1,3-Diaminopropanol-N,N,N',N'-tetramethylenephosphonic acid, and the like.

Among the above, the ferric aminopolycarboxylic acid is preferred, and more preferably, ferric ethylenediamine tetraacetic acid.

The ferric complex salts of the aminopolycarboxylic acids may be used in the form of salts with sodium, potassium, ammonium and the like, although ammonium salts are preferred for fastest bleaching.

The ferric complex salts of the aminopolycarboxylic acids may be used in the form of a complex salt, or the complex salt of the ferric ion may be formed in the solution using an aminopolycarboxylic acid together with a ferric salt, such as ferric sulfate, ferric chloride, ferric nitrate, ferric ammonium sulfate or ferric phosphate. When a complex salt is used, it is possible to use one type of complex salt or a mixture of two or more types of complex salt. On the other hand, when the complex salt is formed in the solution using a ferric salt and an aminopolycarboxylic acid, it may be formed using one or more than one type of ferric salt. Moreover, the ferric complex salt may also be formed using one or more than one type of aminopolycarboxylic acid.

Generally, the bleaching agent should be used in a sufficient amount to effectively oxidize any metallic silver remaining on the photographic material. More specifically, the bleaching agent may be present in an amount from about 10 percent to about 25 percent, and more preferably from about 15 percent to about 20 percent based on total weight of the concentrate.

As described above, any remaining light-sensitive silver halide must be dissolved in a silver halide solvent, commonly referred to as a fixing agent. Whereas the silver halides are almost insoluble, they cannot be removed from the emulsion by water washing, but instead, must be treated with a fixing agent that reacts with the silver halides to form soluble complex salts. Thus understood, in addition to the bleaching agent, at least one fixing agent must be incorporated into the one-part bleach-fix liquid concentrates of the present invention.

Any fixing agent may be used in the present invention that dissolves light-sensitive silver halides without affecting the silver image and that does not cause excessive swelling or softening of the gelatin layer. The most important are the thiosulfates, thiocyanates, thioethers compounds, thioureas, thioglycolic acid, with the proviso that at least a thiocyanate salt is used either alone or in combination with a second different and distinct fixing agent.

Although thiocyanate salts are used as fixing agents they have limited applications. Thiocyanate salts find some application in ultra-rapid processing systems, as they are more rapid than ammonium thiosulfate. However, they do tend to soften gelatin, so that the emulsion should be well hardened, and fixing time very short. They are also much more expensive than thiosulfate salts. Even more important, during silver recovery using electrolytic methods there is the possibility of producing toxic hydrogen cyanide gas. In the past, these disadvantages rendered the use of thiocyanate salts as a fixing agent undesirable as an economical or reliable fixing agent.

Notwithstanding the above disadvantages, it has been discovered that using a thiocyanate salt either alone or in combination with a second fixing agent provides unexpected advantages and benefits. Further it has been found that mixing a quantitative amount of a thiocyanate salt with another fixing agent in a ratio as disclosed in the present invention, provides a one-part bleach-fix liquid concentrate having excellent characteristics. These characteristics include prevention of crystallized precipitates in the concentrate and extended storability while retaining oxidizing capability when diluted to a working solution. This is an entirely unexpected and surprising result. That is, when a mixture of fixing agents contains an amount of a thiocyanate salt, ranging from about 5 to about 20 percent, and more preferably from about 7 percent to about 15 percent by weight based on total weight of fixing agents, there are obtained advantages such as a homogenous concentrate that is essentially free of crystallized precipitates and the bleach-fixing efficiency is maintained even after months of storage.

Typically any thiocyanate salt may be used having a cation selected from sodium, potassium, ammonium, lithium and the like, and preferably ammonium thiocyanate.

Generally, the thiocyanate salt should be used in a sufficient amount to be effective in reducing crystallized precipitates for an extended period of time. More specifically, the thiocyanate salt may be present in an amount from about 1 percent to about 7 percent, and more preferably from about 1.5 percent to about 5 percent based on total weight of the bleach-fix concentrate.

Although the source of the crystallized precipitates is not perfectly clear, it appears that they comprise primarily precipitated salts of the aminopolycarboxylic acid such as ferrous complexes of the aminopolycarboxylic acid. It is believed that the ferrous complex has a lower solubility than a ferric complex. A solution containing these crystals demonstrates an unsatisfactory bleaching capability, that is, the ability to oxidize metallic silver to a silver ion is greatly reduced. While not wishing to be bound by any particular theory of mechanism, it is believed that the inclusion of thiocyanate ions may form a separate and more stable complex with ferric complexes, thereby protecting the ferric complexes from being reduced to ferrous complexes thereby decreasing the precipitation of these ferrous complexes.

When using two different fixing agents, any fixing agent (other than thiocyanate salts) which acts as a silver halide solvent may be used including thiosulfates, thioethers compounds, thioureas, thioglycolic acid and mixtures thereof. Preferably, a thiosulfate salt is used such as sodium thiosulfate, potassium thiosulfate, ammonium thiosulfate, lithium thiosulfate, and guanidine thiosulfate, and more preferably, ammonium thiosulfate.

Ammonium thiosulfate is preferred because solutions containing this fixing agent show a higher rate of fixation than sodium thiosulfate solutions.

The second fixing agent should be in a sufficient amount to effectively act as a silver halide solvent to solubilize any remaining inactivated silver halide. More specifically, the second fixing agent may be present in an amount from about 20 percent to about 30 percent, and more preferably from about 22 percent to about 26 percent based on total weight of the concentrate.

It should be noted that some of the additives encompassed by this invention have been previously used in full working strength solutions. However, the working solutions of the prior art are not made from a one-part bleach-fix liquid concentrate but instead are prepared immediately before use in the bleaching, fixing or bleach-fix processing. Moreover, it was unknown, heretofore, that a specific ratio of a thiocyanate salt to a second fixing agent combined in a one-part bleach-fix liquid concentrate could provide such unexpected results as those demonstrated in the present invention.

Although it is essential and satisfactory that the one-part bleach-fix liquid concentrates contain only bleaching agents and fixing agents including a thiocyanate salt, they may further contain preservatives, alkaline agents, buffering agents, anti-staining agents, and minor amounts of bleaching accelerators, brightening agents, defoaming agents, surfactants, fungicides, anticorrosion agents and organic solvents.

The concentrates of the present invention may contain an effective amount of a preservative for stabilization of a thiosulfate salt fixing agent to reduce any decomposition that may occur due to the oxidizing components in the concentrate. Especially useful for this purpose are sulfurous acid ion releasing compounds such as a sulfite. Sulfites which can be employed as preservatives include sodium sulfite, lithium sulfite, potassium sulfite, ammonium sulfite, sodium bisulfite, ammonium bisulfite, potassium metabisulfite, sodium formaldehyde bisulfite and the like.

Other preservatives which can be used in this invention include hydroxylamine, hydrazine, a bisulfite addition product of an aldehyde compound, such as sodiumacetaldehyde bisulfite.

Generally, the preservative agent should be used in a sufficient amount to be effective in protecting the fixing agents from decomposition. More specifically, the preservative agent may be present in an amount from about 5 percent to about 20 percent, and more preferably, from about 10 percent to about 15 percent based on total weight of the concentrate.

The one-part liquid bleach-fix concentrates of the present invention may further comprise an alkaline agent which becomes basic or alkaline when the concentrates are diluted to a working solution with water. The alkaline agent provides the desired pH level for photographic performance when the photographic material carries the alkaline color development solution into the low pH bleach-fix working solution. Generally, the alkaline agents used are ammonia, potassium hydroxide and sodium hydroxide, and preferably, ammonia.

The alkaline agent should be introduced into the bleach-fix concentrates of the present invention in a sufficient amount to maintain the desired pH in the dilute working strength solution. Typically, an alkaline agent is added in an amount from 0.05 percent to about 3 percent based on total weight of the concentrate.

When photographic materials are transferred from the development bath to the bleach-fix solution it is necessary to neutralize the alkali in the developer to retard further oxidation of the developing agent. If the alkali is not neutralized, the bleach-fix solution can become contaminated with reduced effectiveness. Thus understood, the use of an acid will help to buffer the solution and prevent stains when development of the latent image is not arrested. Practically any acid will function as an anti-staining agent, however, organic acids are more suitable than inorganic acids because they are less dissociated, and therefore, have a correspondingly smaller tendency to precipitate sulfur from the bleach-fix concentrate or the working solutions made from the concentrates. Well-known acids including organic and inorganic acids that are useful for preventing stain and maintaining an acidic pH in the working solutions, prepared from the concentrates of the present invention, include formic acid, acetic acid, monochloroacetic acid, glycolic acid, propionic acid, phosphoric acid, maleic acid, succinic acid and the like. Among these, preferred acids have a carboxyl group, and most preferred is acetic acid.

It is beneficial to add the acid in a sufficient amount to stop further oxidation of the developer and prevent staining of the photographic materials. Preferably, the acid can be added in an amount from about 1 percent to about 5 percent based on total weight of the concentrate.

A full explanation for the superior results of the one-part bleach-fix liquid concentrates has not yet been arrived at. By way of theory only and without limitation, it is suggested that with the further inclusion of acetic acid/acetate ions in the concentrates of the present invention, the ferric/ferrous complex is further stabilized thereby extending the crystal free period within the concentrates.

The present invention may further provide a re-halogenating agent, for example, bromides, such as potassium bromide, sodium bromide, and ammonium bromide; and chlorides, such as potassium chloride, sodium chloride, and ammonium chloride.

The one-part liquid bleach-fix concentrates of the present invention have excellent bleach-fixing power and hence it is not necessary to incorporate a bleaching accelerator. However, if desired, a bleaching accelerator may be incorporated. Specific examples of useful bleaching accelerators include organic sulfur compounds, quaternary ammonium compounds and selenium compounds.

Usually, it is desirable that the full working strength bleach-fix solution be used immediately after color development. Dilution of the one-part bleach-fix liquid concentrates of the present invention may be accomplished using city water, deionized water and sterilized water. The one-part bleach-fix liquid concentrates upon dilution to a working strength solution may then be used effectively for bleaching and fixing photographic materials.

In the bleach-fixing process agitation of the working solution ensures that more of the bleach-fix agents are available to the photographic materials being treated. This results in an increased bleaching and fixing rate. Agitation can be achieved by various techniques including injection of a jet flow of processing solution against the surface of the photosensitive material or increasing the rate of circulation flow through the entire processing solution. The photographic material may be treated in bleach-fix working solution for generally up to 150 seconds, and preferably up to 60 seconds.

The one-part bleach-fix liquid concentrates of the present invention may be used in automatic processors. In general, automatic processors perform continuous processing in either a "replenishment" or "batch" mode. In the replenishment mode, replenisher are made up in amounts proportional to the quantity of color photosensitive material processed in order to keep the performance of processing solutions constant. In the batch mode all or part of the used processing solution is replaced with a fresh solution whenever the quality of color photo sensitive material processed reaches a predetermined level.

When replenishment mode is used, silver recovery is necessary to regenerate spent bleach-fix solutions to permit their reuse. As part of the regeneration, it is necessary to remove the silver from the spent bleach-fix solution, and this is most advantageously accomplished by the use of electrolytic silver recovery systems. Such systems function to plate out the dissolved silver as metallic silver on the cathode of the electrolytic apparatus. After a sufficient amount of silver has been collected on the cathode, it is removed from the cathode and subjected to appropriate refining processes to permit its reuse. Conditions used in carrying out the electrolytic silver recovery are varied but higher temperatures and increased power density can cause the formation of toxic fumes when the fixing agent is a thiocyanate salt. However, advantageously by combining a thiocyanate salt with a second fixing agent the concentration of thiocyanate is low enough to reduce the production of any significant amount of hydrogen cyanide gas.

The present invention is illustrated below with reference to the following examples, but the scope of the invention is not limited to the examples.

EXAMPLE 1

A one-part bleach-fix liquid concentrate was prepared using the following basic formulation as shown below:

| | |
|---|---|
| Ammonium thiosulfate • 58.6% | 400.0 ml/L |
| Ammonium bisulfate • 70% | 160.0 ml/L |
| Aqua ammonia • 28% | 40.0 ml/L |
| Photo iron • 100 g/L Fe* | 340.0 ml/L |
| Acetic Acid • 100% | 35.0 ml/L |
| Ammonium thiocyanate | 30.0 g/L |
| pH | 5.70–5.80 |

*Ferric ammonium EDTA complex

The components were added sequentially in a single vessel providing approximately 1 liter of the one-part concentrate of the present invention. The vessel was placed in storage at ambient pressure and at a temperature of approximately 20° C. The one-part liquid concentrate prepared according to the above formulation remained crystal free even after 14 months of storage.

COMPARATIVE EXAMPLE 2

To illustrate the importance of including at least some thiocyanate salt to prevent crystallized precipitates forming in the concentrates of the present invention, a one-part concentrate was prepared without the addition of any thiocyanate salt according to the following formula:

| | |
|---|---|
| Ammonium thiosulfate • 58.6% | 500.0 ml/L |
| Ammonium bisulfate • 70% | 160.0 ml/L |
| Aqua ammonia • 28% | 40.0 ml/L |
| Photo iron • 100 g/L Fe* | 340.0 ml/L |
| Acetic Acid • 100% | 35.0 ml/L |
| pH | 5.70–5.80 |

* Ferric ammonium EDTA complex

The components were added to a single vessel providing approximately 1 liter of a one-part concentrate. It should be noted that the concentration of the thiosulfate salt was increased because a second fixing agent was not included in the concentrate. The vessel was placed in storage at ambient pressure and at a temperature of approximately 20° C.

Results: The one-part liquid concentrate prepared without the addition of a thiocyanate salt produced crystallized precipitates in the concentrate in approximately one month indicating the importance of including a sufficient amount of a thiocyanate salt to provide a one-part concentrate that is essentially free of crystallized precipitates.

EXAMPLE 3

Several different concentrations of a thiocyanate salt were added to the formulation of Example 1 to illustrate the increasing shelf-life of the concentrates with the addition of increasing amounts of the thiocyanate salt in the concentrates of the present invention.

| Amount of Ammonium Thiocyanate | Amount of Ammonium thiosulfate | Time free of crystals |
|---|---|---|
| 10 g/L | 400.0 ml/L | 5 months |
| 20 g/L | 400.0 ml/L | 10 months |
| 30 g/L | 400.0 ml/L | >14 months |
| 40 g/L | 400.0 ml/L | >14 months |
| 300 g/L | 0 | >24 months |

The above results illustrate that the shelf-life of the one-part bleach-fix liquid concentrates may exceed one year by the addition of at least 30 g/L of a thiocyanate salt. When a thiocyanate salt was added without the addition of a second fixing agent the concentrate did not formed crystals in two years. However, it should be noted that high concentrations of thiocyanate salt may form toxic hydrogen cyanide gas during electrolytic recovery of silver from a spent bleach-fix solution.

EXAMPLE 4

The formulation of Example 1 was prepared, however, the acetic acid was not added to the one-part bleach-fix concentrate as shown below.

| | |
|---|---|
| Ammonium thiosulfate • 58.6% | 400.0 ml/L |
| Ammonium bisulfate • 70% | 160.0 ml/L |

-continued

| | |
|---|---|
| Photo iron • 100 g/L Fe* | 340.0 ml/L |
| Ammonium thiocyanate | 30.0 g/L |
| pH | 5.70–5.80 |

* Ferric ammonium EDTA complex

Results: Initially it should be stated that the lack of acetic acid in the concentrate obviated the need for an alkaline agent to help buffer the acid. It was found that this formulation wherein acetic acid is absent, produced crystals in about 6–7 months. Clearly, the acetic acid plays a role in the stabilization of the one-part concentrates. While not wishing to be bound by any specific mechanism of action, it is believed that the acetic acid either further stabilizes the iron complex or simply increases the buffer capacity of the concentrate.

I claim:

1. A storage stable one-part bleach-fix liquid concentrate comprising:

a) a bleaching agent that oxidizes metallic silver; and b) a fixing mixture of at least a first and second fixing agent, the first fixing agent being a thiocyanate salt in an effective amount to substantially retard crystal formation in the one-part bleach-fix liquid concentrate to form the storage stable one-part bleach-fix liquid concentrate suitable for dilution to a working strength solution.

2. The one-part bleach-fix liquid concentrate of claim 1 wherein the thiocyanate salt is ammonium thiocyanate.

3. The one-part bleach-fix liquid concentrate of claim 1 wherein the thiocyanate salt is in an amount by weight less than or equal to the amount by weight of the second fixing agent in the fixing mixture.

4. The one-part bleach-fix liquid concentrate of claim 1 wherein the extended shelf-life of the one-part bleach fix liquid concentrate increases as the amount of thiocyanate salt increases in the one-part bleach-fix liquid concentrate.

5. The one-part bleach-fix liquid concentrate of claim 1 wherein the bleaching agent is a polyvalent metal oxidizing agent.

6. The one-part bleach-fix liquid concentrate of claim 1 wherein the second fixing agent is a thiosulfate salt.

7. The one-part bleach-fix liquid concentrate of claim 1 wherein the extended shelf-life of the one-part bleach-fix liquid concentrate is at least six months.

8. The one-part bleach-fix liquid concentrate of claim 5 wherein the polyvalent metal oxidizing agent is an iron complex of an aminopolycarboxylic acid.

9. The one-part bleach-fix liquid concentrate of claim 1 further comprising a alkaline agent selected from the group consisting of ammonia, potassium hydroxide and sodium hydroxide.

10. The one-part bleach-fix liquid concentrate of claim 1 further comprising an organic acid selected from the group consisting of formic acid, acetic acid, monochloroacetic acid, glycolic acid, propionic acid, maleic acid, succinic acid and phosphoric acid.

11. The one-part bleach-fix liquid concentrate of claim 1 wherein the thiocyanate salt is in an amount from about 5 percent to about 15 percent of the mixture of fixing agents.

12. The one-part bleach-fix liquid concentrate according to claim 6 wherein the cation of the thiosulfate salt is selected from the group consisting of sodium, potassium, ammonium and mixtures thereof.

13. The one-part bleach-fix liquid concentrate according to claim 1 further comprising a preservative which is a sulfite selected from the group of sodium sulfite, potassium sulfite, ammonium sulfite, and mixtures thereof.

14. The one-part bleach-fix liquid concentrate of claim 10 wherein the one-part bleach-fix liquid concentrate has a pH ranging from about 5.6 to about 5.9.

15. The one-part bleach-fix liquid concentrate of claim 1 wherein the fixing mixture contains the thiocyanate salt in an amount from about 5 to about 20 percent.

16. A one-part bleach-fix liquid concentrate comprising:

a) a bleaching agent which is a ferric complex of ethylenediaminetetraacetic acid;

b) an organic acid; and c) a combination of at least a first and second fixing agent, the first fixing agent is ammonium thiocyanate salt, the second fixing agent is ammonium thiosulfate, the amount by weight of ammonium thiocyanate is less than the amount by weight of ammonium thiosulfate and the ammonium thiocyanate salt being in an effective amount to substantially retard the formation of crystallized precipitates in the one-part bleach-fix liquid concentrate thereby forming a storage stable one-part bleach-fix liquid concentrate suitable for dilution to a working strength solution.

17. The one-part bleach-fix liquid concentrate of claim 16 wherein the ammonium thiocyanate salt is in an amount from about 1 to 7 percent based on the total weight of the bleach-fix concentrate.

18. A one-part bleach-fix liquid concentrate having extended storability while remaining essentially free of crystallized components which comprises:

a) a bleaching agent that oxidizes metallic silver;

b) at least one fixing agent, the fixing agent being a thiocyanate salt, the thiocyanate salt in a sufficient amount to substantially retard crystal formation in the one-part bleach-fix liquid concentrate; and c) an organic acid in a sufficient amount to maintain an acidic pH in the one-part bleach-fix liquid concentrate, the pH ranging from about 5.6 to about 5.9 thereby forming a storable and stable one-part bleach-fix liquid concentrate suitable for dilution to provide a working strength solution.

19. The one-part bleach-fix liquid concentrate of claim 18 wherein the organic acid is acetic acid.

20. A photographic one-part bleach-fix liquid concentrate kit comprising a one-part bleach-fix concentrate suitable for dilution to provide a working strength bleach-fix solution, the kit comprising:

a) a bleaching agent that oxidizes metallic silver; and b) a fixing mixture of at least a first and second fixing agent, the first fixing agent being a thiocyanate salt in an amount sufficient to substantially retard crystal formation in the one-part bleach-fix liquid concentrate to form a storage stable one-part bleach-fix liquid concentrate suitable for dilution to provide a working strength bleach-fix solution.

21. The photographic bleach-fix kit of claim 20 wherein the thiocyanate salt is ammonium thiocyanate.

22. The photographic bleach-fix kit of claim 20 wherein the bleaching agent is a polyvalent metal oxidizing agent.

23. The photographic bleach-fix kit of claim 20 wherein the second fixing agent is a thiosulfate salt.

24. The photographic bleach-fix kit of claim 22 wherein the polyvalent metal oxidizing agent is an iron complex of an aminopolycarboxylic acid.

25. The photographic bleach-fix kit of claim 20 further comprising a alkaline agent selected from the group consisting of ammonia, potassium hydroxide and sodium hydroxide.

26. The photographic bleach-fix kit of claim 20 further comprising an acid selected from the group consisting of formic acid, acetic acid, monochloroacetic acid, glycolic acid, propionic acid, maleic acid, succinic acid and phosphoric acid.

27. The photographic bleach-fix kit of claim 20 wherein the thiocyanate salt is in an amount from about 5 percent to about 15 percent of the combination of fixing agents.

28. The photographic bleach-fix kit of claim 20 further comprising a preservative which is a sulfite selected from the group of sodium sulfite, potassium sulfite, ammonium sulfite, and mixtures thereof.

29. The photographic bleach-fix kit of claim 20 wherein the amount by weight of the thiocyanate salt is less than the amount by weight of the second fixing agent.

30. The photographic bleach-fix kit of claim 20 packaged in a single unit.

31. The photographic one-part bleach-fix liquid concentrate kit of claim 20 further comprising an organic acid.

32. The photographic one-part bleach-fix liquid concentrate kit of claim 20 wherein the fixing mixture contains the thiocyanate salt in an amount from about 5 to about 20 percent.

33. A method of making and reducing the formation of crystallized precipitates in a one-part bleach-fix liquid concentrate, the method comprising:

a) combining a bleaching agent that oxidizes metallic silver with a fixing mixture of at least a first and second fixing agent, the first fixing agent being a thiocyanate salt in an effective amount to substantially retard the formation of crystallized precipitates in the one-part bleach-fix liquid concentrate to form a storage stable liquid concentrate suitable for dilution to provide a working strength solution.

34. The method of claim 33 wherein the second fixing agent is a thiosulfate salt.

35. The method of claim 33 wherein the first fixing agent is approximately one-tenth the amount by weight of the second fixing agent.

36. The method of claim 33 wherein the bleaching agent is a complexed polyvalent metal oxidizing agent.

37. The method of claim 36 wherein the polyvalent metal oxidizing agent is an iron complex of an aminopolycarboxylic acid.

38. The method of claim 33 further comprising a sulphite selected from the group consisting of sodium sulphite, potassium sulfite, ammonium sulfite and mixtures thereof.

39. The method of claim 33 further comprising acetic acid.

* * * * *